United States Patent [19]

Krempp et al.

[11] 4,158,277

[45] Jun. 19, 1979

[54] DOOR ARRANGEMENT

[75] Inventors: Stanley G. Krempp; David J. Berger, both of Jasper, Ind.

[73] Assignee: The United Cabinet Corporation, Jasper, Ind.

[21] Appl. No.: 693,142

[22] Filed: Jun. 7, 1976

Related U.S. Application Data

[63] Continuation of Ser. No. 543,327, Jan. 23, 1975, abandoned.

[51] Int. Cl.[2] ..... E06B 3/54

[52] U.S. Cl. ..... 52/476; 49/501; 312/282; 312/204

[58] Field of Search ..... 312/282; 52/476, 456, 52/455; 49/501, 401

[56] References Cited

U.S. PATENT DOCUMENTS

| | | | |
|---|---|---|---|
| 12,717 | 11/1907 | Stevenson | 49/401 |
| 471,663 | 3/1892 | Young | 52/476 |
| 656,130 | 8/1900 | Whipple | 52/476 |
| 737,144 | 8/1903 | Richardson | 52/476 |
| 911,619 | 2/1909 | Smallwood | 52/476 |
| 961,896 | 6/1910 | Reaves | 52/476 |
| 974,575 | 11/1910 | Knoerl | 52/476 |
| 1,018,101 | 2/1912 | Doll | 52/476 |
| 2,046,251 | 6/1936 | Daniels | 52/476 |
| 2,499,455 | 3/1950 | Brochu | 312/282 |

*Primary Examiner*—Victor N. Sakran
*Attorney, Agent, or Firm*—Warren D. Flackbert

[57] ABSTRACT

A door arrangement having particular adaptability for use on a storage cabinet characterized by a frame positioning a reversible or interchangeable panel, the latter being slideable into a received position upon removal of a portion or section of the frame.

1 Claim, 4 Drawing Figures

DOOR ARRANGEMENT

This is a continuation of application Ser. No. 543,327, filed Jan. 23, 1975, now abandoned.

As is known, the use of built-in cabinets, such as those found in the bathroom, dressing area or the kitchen of a typical home, or elsewhere, is quite widespread. Such cabinets are used for storage purposes and generally assume various outward aesthetic appearances to blend with the overall interior decor of each particular surrounding. Usually, the doors to such cabinets are hinged and represent a fixed finalized artistic design.

The invention provides an important versatility to the appearance of cabinet doors, broadly being an arrangement wherein a cabinet door is characterized by a frame; a removable portion forming part of the frame; and a reversible or interchangeable panel slideably maintained in position on said frame after removal of the aforesaid portion and the subsequent replacement thereof.

In other words, frame or framework for the cabinet door may assume different visual front impressions, utilizing one or more openings blending together to achieve any desired end appearance. With the use of the aforesaid reversible or interchangeable panel, different forms of ultimate design can be accomplished. In this connection, and by way of example, one surface of the panel could be cane-like or roughened in texture, while the opposite surface could be plain and adaptable for paint, wallpapering or the like.

In other words, the owner is provided with a door, or doors, which can be changed from time to time to accommodate various interior designs. Thus, and as stated, a high factor of versatility is provided, where style changes or trends can be readily achieved, or, for further example, when a new occupant of a dwelling is faced with an already existing color combination unsuitable to desired needs.

While the invention is directed to built-in cabinets, its susceptibility lends itself for use with doors for free-standing units or any other forms of decorative access doors or entry arrangements.

A better understanding of the present invention will become more apparent from the following description, taken in conjunction with the accompanying drawing, wherein FIG. 1 is a view in front elevation of a door arrangement in accordance with the teachings of the present invention;

Figures 1, 2, 3, 4:
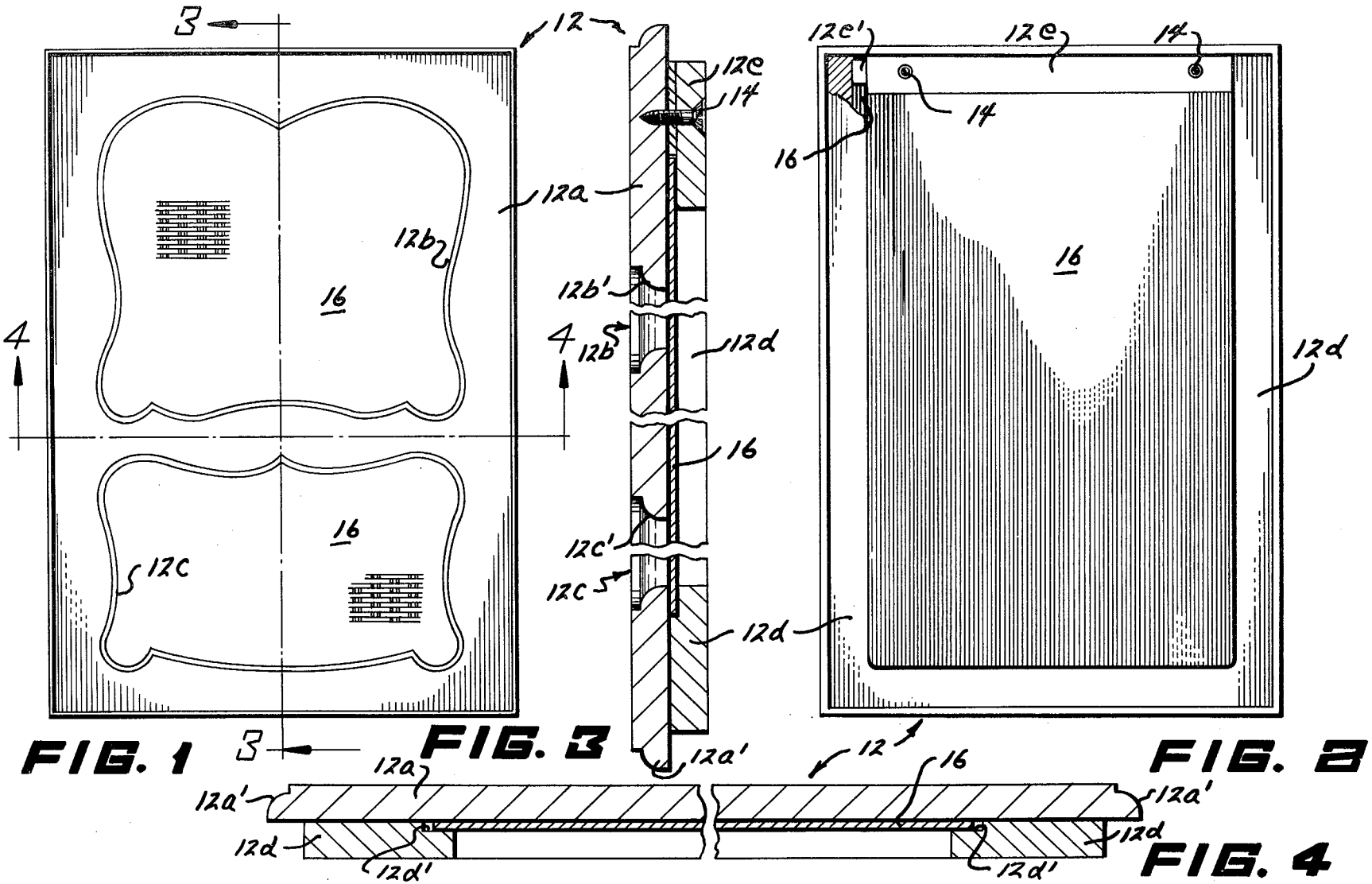
FIG. 2 is a view in rear elevation of the door arrangement of FIG. 1, with a portion thereof in vertical section.
FIG. 3 is a view in vertical section, taken at line 3—3 of FIG. 1 and looking in the direction of the arrows, being partly fragmentary, showing certain details of the invention; and, FIG. 4 is a view in horizontal section, also partly fragmentary, but in this instance taken at line 4—4 of FIG. 1 and looking in the direction of the arrows, illustrating other details of the invention.

For purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, the door arrangement of the invention herein is characterized by a frame 12, the front surface **12*a* thereof having cut-out portions 12*b* and 12*c***, the latter typically assuming various ornamental configurations. In the illustration, a Country French or Provencal representation is depicted.

The frame 12 may have beveled or rounded edges **12*a*' (see FIGS. 3 and 4), where, additionally, in the embodiment shown, the cut-out portions 12*b* and 12*c* also have beveled or rounded edges 12*b*' and 12*c*'**, all supporting an overall decorative effect.

As further evident in FIGS. 2, 3 and 4, the rear of the frame 12 is defined by a strip-like edge member **12*d*, being continuous, as in the shape of a "U" (in the illustration), or sectionalized (not shown). Representively, and with further references to FIGS. 2 and 3, the rear of the frame 12 includes a removable part or member 12*e*. While the removable member 12*e* is shown as being along the top edge of the rear of the frame 12 in the drawing, alternative approaches could include such as being along a side edge or even the bottom edge of the rear of the frame 12**.

As evident, member **12*e* has tongues 12*e*' at opposite ends thereof, where such member 12*e* is secured in position by fastening means 14, such as conventional flush mounted screws. The aforesaid tongues 12*e*' of the removable member 12*e* are adapted to be received in cut-out portions of channelways 12*d*' along the inside surfaces of the sides and bottom of edge member 12*d***.

Importantly, a panel 16 is received in a sliding relationship in such cut-outs or channelways **12*d*'. In a typical embodiment of the invention, the panel 16** may be wooden, decorative plastic, smooth or textured fiberboard, or the like, depending upon desired end goals.

In use, and when assembled, the panel 16 is received within the cut-outs or channelways **12*d*', where, in the illustration, panel 16 is depicted as having a cane-like front configuration and a smooth rear surface. If a different effect is desired, the fastening means 14 are unscrewed and the member 12*e* lifted from the position of FIG. 2. Thereafter, the panel 16 is removed by sliding action and, typically, reversed, or even interchanged with another panel. In any event, and again with respect to the illustration, the rear surface of the panel 16** now becomes the front surface, where such could be painted, wallpapered or the like prior to positioning.

Thus, a completely different aesthetic appearance is achieved after reversing or interchanging action, and when member **12*e* is returned to the position of FIG. 2** and again re-fastened. It should be noted that the preceding can be accomplished without removing the door frame from its position on the cabinet.

Thus, the invention represents an improved and effective approach to custom interior design. The door arrangement described herein is susceptible to various changes, as in proportioning, decorative configurations and the like, and, therefore, the preceding should be considered illustrative and not as limiting the scope of the following claims: We claim:

1. A cabinet door arrangement comprising a frame having a front portion and a rear portion, said rear portion adapted to be received within a door opening and said front portion overlying said rear portion and concealing said door opening, said rear portion having a fixed section and a selectively removable section, a channelway defined in said fixed section, said selectively removable section having tongues cooperating with said channelway, an interchangeable cabinet door panel disposed within said channelway in sliding relationship, and fastening means cooperating with said front portion securing said selectively removable section in retaining relationship with respect to said interchangeable cabinet door panel, said front portion of said frame being cut-out to reveal said interchangeable cabinet door panel, and said interchangeable cabinet door panel having a decorative front surface and a decorative rear surface selectively and reversibly revealed through said cut-out in said front portion.

* * * * *